US008218796B2

(12) United States Patent
Tanaka et al.

(10) Patent No.: US 8,218,796 B2
(45) Date of Patent: Jul. 10, 2012

(54) MICROPHONE UNIT AND METHOD OF MANUFACTURING THE SAME

(75) Inventors: Fuminori Tanaka, Osaka (JP); Ryusuke Horibe, Osaka (JP); Takeshi Inoda, Osaka (JP); Rikuo Takano, Ibaraki (JP); Kiyoshi Sugiyama, Tokyo (JP); Toshimi Fukuoka, Kanagawa (JP); Masatoshi Ono, Ibaraki (JP)

(73) Assignees: Funai Electric Advanced Applied Technology Research Institute Inc., Osaka (JP); Funai Electric Co., Ltd., Osaka (JP)

( * ) Notice: Subject to any disclaimer, the term of this patent is extended or adjusted under 35 U.S.C. 154(b) by 342 days.

(21) Appl. No.: 12/433,466

(22) Filed: Apr. 30, 2009

(65) Prior Publication Data

US 2009/0274324 A1 Nov. 5, 2009

(51) Int. Cl.
*H04R 25/00* (2006.01)

(52) U.S. Cl. ..... 381/176; 381/121; 381/174; 381/178; 381/191

(58) Field of Classification Search ..... 381/122, 381/121, 174, 176, 178, 191
See application file for complete search history.

(56) References Cited

U.S. PATENT DOCUMENTS

| | | | | |
|---|---|---|---|---|
| 2003/0068055 | A1* | 4/2003 | Tanabe et al. | 381/191 |
| 2007/0047746 | A1* | 3/2007 | Weigold et al. | 381/174 |
| 2007/0158826 | A1* | 7/2007 | Sakakibara et al. | 257/723 |
| 2008/0006093 | A1* | 1/2008 | Ueya | 73/724 |

FOREIGN PATENT DOCUMENTS

JP 2006-157863 6/2006

OTHER PUBLICATIONS esp@cenet patent abstract for Japanese Publication No. 2006157863, Publication date Jun. 15, 2006 (1 page).

* cited by examiner

*Primary Examiner* — Minchul Yang
(74) *Attorney, Agent, or Firm* — Osha • Liang LLP

(57) ABSTRACT

A microphone unit includes a substrate. The substrate includes a first face formed with a first recess, a second face opposite to the first face, and a through hole communicating the second face to a bottom part of the first recess. A diaphragm unit includes a diaphragm, and at least a part of which is disposed in the first recess so that the diaphragm opposes the through hole.

19 Claims, 8 Drawing Sheets

Fig. 1A
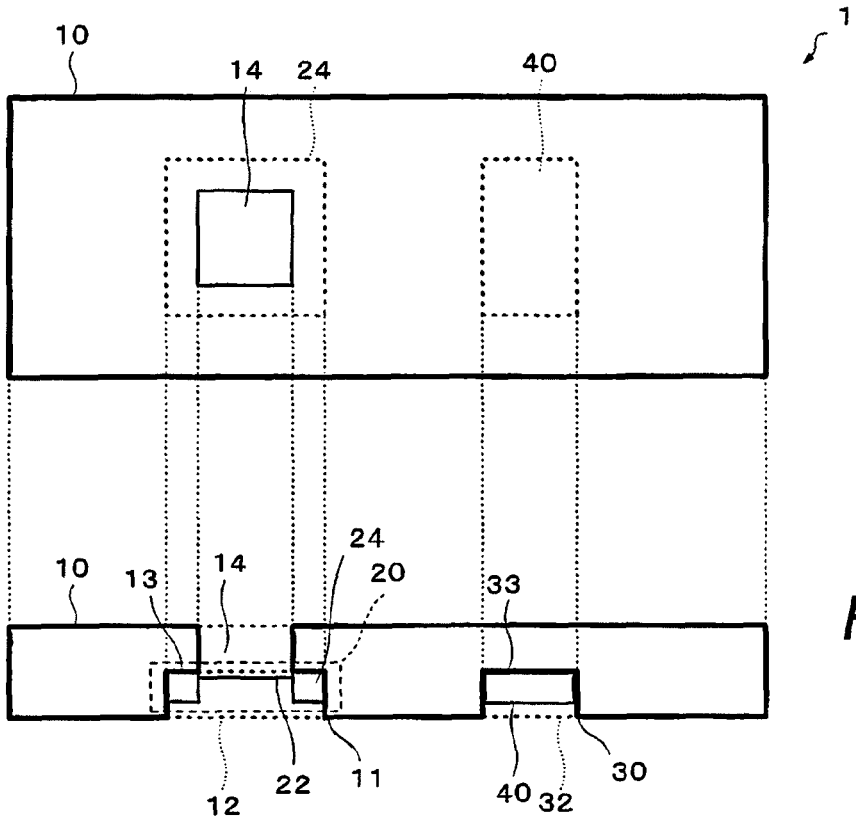
Fig. 1B
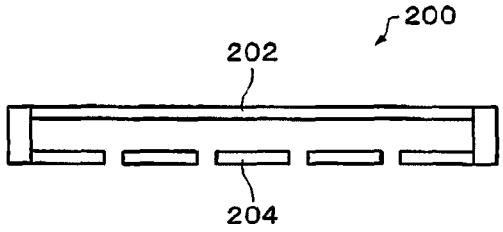
Fig. 2

Fig. 8A
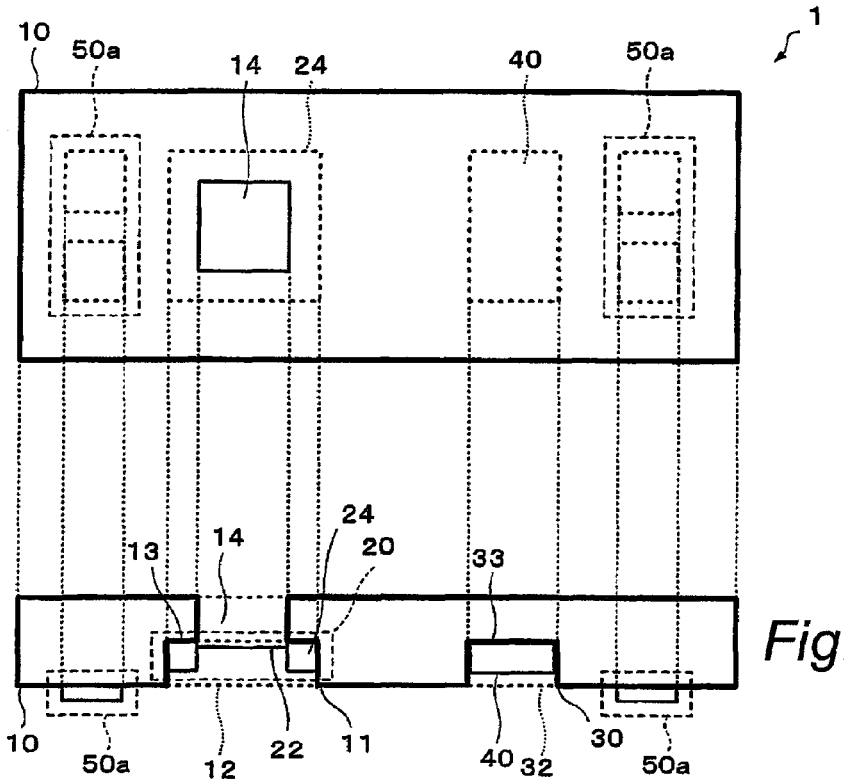
Fig. 8B
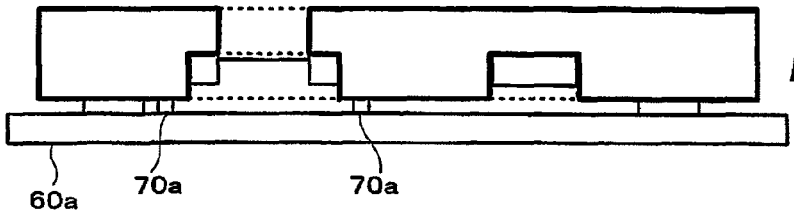
Fig. 8C

MICROPHONE UNIT AND METHOD OF MANUFACTURING THE SAME

BACKGROUND

The present invention relates to a microphone unit and a method for manufacturing the same.

A technique for downsizing a sound input device has become important with a reduction in size of electronic equipment. For instance, a technique for manufacturing capacitor microphones on a silicon substrate has been developed as such a technique (see; for instance, Japanese Patent Publication No. 2006-157863 A).

In the thus-downsized sound input device, arranging a microphone at a desired position becomes more difficult with an increase in size reduction. However, in order to manufacture a sound input device having a desired characteristic, the position of the microphone also becomes a important design factor.

SUMMARY

It is therefore one advantageous aspect of the present invention to provide a microphone unit that enables easy arrangement of a microphone at a desired location and a method for manufacturing the microphone unit are provided.

According to one aspect of the invention, there is provided a microphone unit, comprising:

a substrate including:

a first face formed with a first recess;

a second face opposite to the first face; and a through hole communicating the second face to a bottom part of the first recess; and a diaphragm unit including a diaphragm, and at least a part of which is disposed in the first recess so that the diaphragm opposes the through hole.

A diaphragm unit may be configured as MEMS (Micro Electro Mechanical System). A diaphragm may be an element that performs electro-acoustic conversion by a piezoelectric effect using an inorganic thin piezoelectric film or an organic thin piezoelectric film. Further, the diaphragm may employ an electrets film. The microphone substrate may be made of a material, such as an insulation molding material, sintered ceramics, glass epoxy, and plastic.

The microphone unit may be configured such that the first recess is opened while being enlarged from the bottom part.

The microphone unit may further comprise a cover covering the first recess.

The microphone unit may further comprise a cover covering the diaphragm in the first recess.

The microphone unit may be configured such that an opening of the first recess has a polygonal shape.

The microphone unit may be configured such that an opening of the first recess has a circular shape.

The microphone unit may be configured such that a whole part of the diaphragm unit is disposed in the first recess.

The microphone unit may further comprise a signal processor configured to process a signal output from the diaphragm unit, wherein the substrate is formed with a second recess accommodating at least a part of the signal processor.

The microphone unit may be configured such that the second recess is formed in the first face of the substrate.

The microphone unit may further comprise an electrode disposed on the first face of the substrate and electrically connected to the signal processor.

The microphone unit may further comprise an electrode disposed on the second face of the substrate and electrically connected to the signal processor.

According to another aspect of the invention, there is provided a method for manufacturing a microphone unit, comprising:

preparing a substrate including a first face formed with a first recess, a second face opposite to the first face, and a through hole communicating the second face to a bottom part of the first recess;

preparing a diaphragm unit including a diaphragm; and disposing at least a part of the diaphragm unit in the first recess so that the diaphragm opposes the through hole.

BRIEF DESCRIPTION OF THE DRAWINGS

FIG. 1A is a plan view of a microphone unit according to a first embodiment of the present invention.

FIG. 1B is a sectional view of the microphone unit shown in FIG. 1A.

FIG. 2 is a view showing a configuration of a capacitor microphone mounting a microphone unit according to the present invention.

FIG. 8A is a plan view of a microphone unit according to a fifth embodiment of the present invention.

FIG. 8B is a sectional view of the microphone unit shown in FIG. 8A.

FIG. 8C is a sectional view showing the microphone unit shown in FIG. 8A connected to a substrate.

DETAILED DESCRIPTIONS OF EXEMPLIFIED EMBODIMENTS

Figures 3A, 3B:
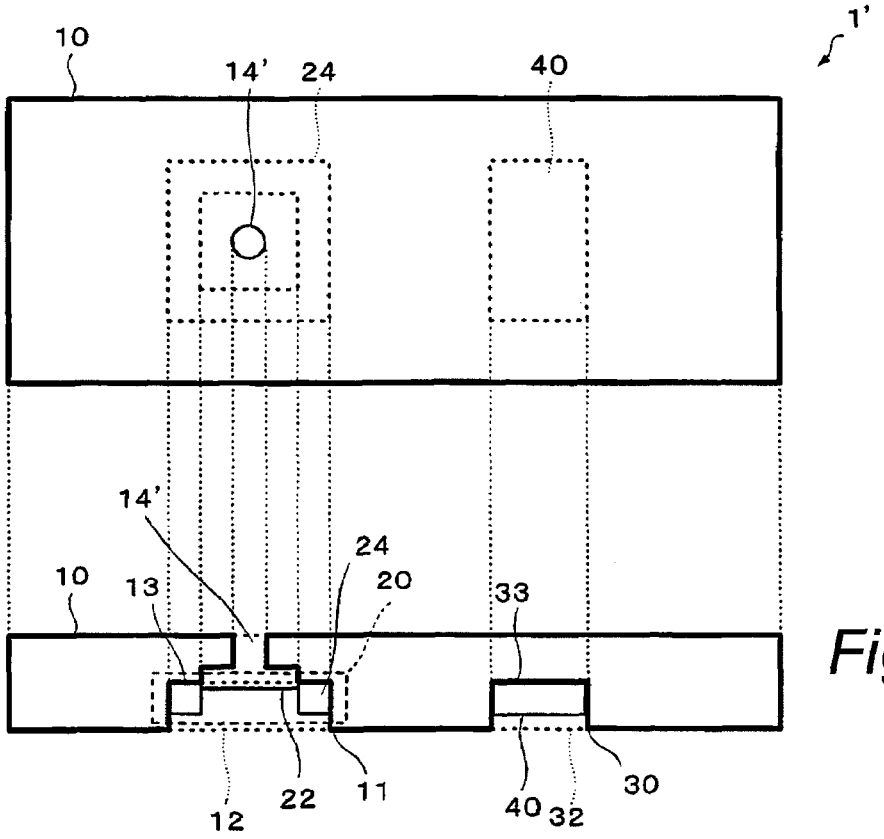
FIG. 3A is a plan view of modified example of the microphone unit shown in FIG. 1A.
FIG. 3B is a sectional view of the microphone unit shown in FIG. 3A.

Exemplified embodiments of the invention are described below in detail with reference to the accompanying drawings.

As shown in FIGS. 1A and 1B, a microphone unit 1 according to a first embodiment of the present invention includes a microphone substrate 10. The microphone substrate 10 has a diaphragm unit arrangement area 11 made in the form of a recess.

A shape of an opening 12 of the recess that is to serve as the diaphragm-unit arrangement area 11 is not particularly limited and may be rectangular, polygonal, or circular, for instance. In the present embodiment, the shape of the opening 12 is square.

Further, in the present embodiment, the recess of the diaphragm-unit arrangement area 11 is shaped into a prismatic column whose bottom includes a parallel face 13 parallel to the opening 12.

The microphone substrate 10 may be made of a material, such as insulative molded material, baked ceramics, glass epoxy, and plastic. The microphone substrate 10 having the recessed diaphragm-unit arrangement area 11 may be manufactured by pressing a mold having a projection against an insulative molded material; by molding baked ceramic with a mold having a desired shape; or by bonding together a plurality of substrates, one having a through hole and the other having no through hole.

The microphone unit 1 of the embodiment includes a diaphragm-unit 20. The diaphragm-unit 20 is disposed at the recessed diaphragm-unit arrangement area 11 in the microphone substrate 10.

The diaphragm-unit 20 includes in part a diaphragm 22. Moreover, the diaphragm-unit 20 may have a holding part 24 for holding the diaphragm 22.

The diaphragm 22 is a member that vibrates in a direction normal to a main face when acoustic waves incident on the diaphragm. The microphone unit 1 extracts an electric signal in accordance with vibration of the diaphragm 22, thereby acquiring an electric signal showing sound incident of the diaphragm 22. Specifically, the diaphragm 22 is a diaphragm of the microphone.

A configuration of a capacitor microphone 200 is described below as an example to which the above embodiment is applicable, by reference to FIG. 2.

The capacitor microphone 200 has a diaphragm 202. The diaphragm 202 corresponds to the diaphragm 22 of the microphone unit 1 of the embodiment. The diaphragm 202 is a membrane (a thin film) that vibrates according to received acoustic waves, has conductivity, and defines one end of an electrode. The capacitor microphone 200 has an electrode 204. The electrode 204 disposed opposite in close proximity to the diaphragm 202, and opposite to the diaphragm 202. As a result, the diaphragm 202 and the electrode 204 constitute a capacitor. When acoustic waves incident on the capacitor microphone 200, the diaphragm 202 vibrates, an interval between the diaphragm 202 and the electrode 204 changes, so that electrostatic capacitance between the diaphragm 202 and the electrode 204 changes. An electric signal based on vibration of the diaphragm 202 can be acquired by detecting changes in electrostatic capacitance as, for instance, voltage changes. In other words, acoustic waves incident on the capacitor microphone 200 can be converted into and output as an electric signal. The electrode 204 may be configured so as not to be affected by acoustic waves. For instance, the electrode 204 may be meshed structure.

The microphone (the diaphragm 22) applicable to the present invention is not limited to a capacitor microphone, and any of conventional microphones may be applied to the present invention. For instance, the diaphragm 22 may be any of diaphragms of various microphones, such as an electrodynamic (dynamic) microphone, an electromagnetic (magnetic) microphone, and a piezoelectric (crystal) microphone.

Alternatively, the diaphragm 22 may be made of a semiconductor film (e.g., a silicon film). For example, the diaphragm 22 may be a diaphragm of a silicon microphone (an Si microphone). The microphone unit 1 can be downsized and the performance can be enhanced by using the silicon microphone.

In the present embodiment, a shape of a vibration face of the diaphragm 22 is square, but may be circular or polygonal.

The microphone substrate 10 has a through hole 14 that communicates a obverse face of the microphone substrate 10 in which the opening 12 is formed and a reverse face of the microphone substrate 10 opposite to the obverse face. By virtue of the through hole, a sound pressure can be input from the reverse face side of the microphone substrate 10. Further, since sound pressure can be input from the obverse face side of the microphone substrate 10, the microphone substrate 10 can be caused to operate as a differential microphone by a configuration including a single diaphragm 22.

The diaphragm-unit arrangement area 11 may have the parallel face 13 parallel to the opening 12 at bottom, and the opening of the through hole 14 facing the diaphragm-unit 20 may be provided in the parallel face 13. The diaphragm-unit 20 can thereby be fixed by utilization of the parallel face 13.

Moreover, since whole of one face of the diaphragm 22 faces an inner space of the through hole 14, the diaphragm 22 is not prevented vibrating by contacting the microphone substrate 10. Therefore, the whole of the diaphragm 22 can be caused to effectively work as a diaphragm of a microphone. Shapes of two openings of the through hole 14 are not particularly limited. In the present embodiment, the two openings of the through hole 14 are square but may be circular or polygonal.

The two openings of the through hole 14 may be of different sizes and shapes. A obverse face side opening of the through hole 14' may be larger than a reverse face side opening of the through hole 14', so that whole of one face of the diaphragm 22 faces an inner space of the through hole 14'.

Moreover, the microphone unit 1 of the embodiment includes a signal processor 40 that processes a signal output from the diaphragm-unit 20. In addition, the microphone substrate 10 has a recessed signal processor arrangement area 30, and the signal processor 40 may be disposed in the signal processor arrangement area 30.

An electrode terminal 205 (not shown) is provided on a parallel face 13 of the diaphragm-unit arrangement area 11 and electrically connected to an electrode terminal 206 (not shown) of the diaphragm-unit 20 by soldering, or the like. An electrode terminal 207 (not shown) is provided on a bottom face 33 of the signal processor arrangement area 30 and electrically connected to an electrode terminal 208 (not shown) of the signal processor 40 by soldering, or the like.

The electrode terminal 205 of the diaphragm-unit arrangement area 11 and the electrode terminal 207 of the signal processor arrangement area 30 are connected together by a wiring pattern laid in the microphone substrate 10 or on a face of the microphone substrate 10. Further, the electrode terminal 207 of the signal processor arrangement area 30 and an electrode part 50 or an electrode part **50*a* are electrically connected together by a wiring pattern laid in the microphone substrate 10 or on the face of the microphone substrate 10**.

By the above described configuration, there can be realized a microphone unit reduced in thickness as compared with a microphone unit which the signal processor 40 is placed directly on the face of the microphone substrate 10.

According to the microphone unit 1 of the present embodiment, there can be realized a microphone unit that enables easy arrangement of the diaphragm-unit 20, which works as a microphone, at a desired position, by disposing in the recessed diaphragm-unit arrangement area 11 made in the form of a recess.

The thickness of the microphone substrate 10 can be increased except the recessed diaphragm-unit arrangement area 11. Hence, the rigidity of the microphone unit 1 is increased. Consequently, a microphone unit easier to handle can be realized.

In the present embodiment, viewed from the opening 12, a shape of the recess of the diaphragm-unit arrangement area 11 is essentially identical with the shape of the diaphragm-unit 20, so that the diaphragm-unit 20 is fitted into the diaphragm-unit arrangement area 11. Therefore, positioning performed at the time of manufacture is facilitated and made reliable.

Since components of the diaphragm-unit 20 and components of the signal processor 40 are very small components approximately measuring 1 to 2 mm per size, handling the components during mount operation is difficult. In particular, when the electrode terminal 205 of the diaphragm-unit arrangement area 11 and the electrode terminal 206 of the diaphragm-unit 20 are rotated or displaced during being soldered by reflow processes.

However, in the above configuration, the positions of the diaphragm-unit 20 and the signal processor 40 are regulated by the recess of the microphone substrate 10. Hence, even when the electrode terminal 205 of the diaphragm-unit arrangement area 11 and the electrode terminal 206 of the diaphragm-unit 20 are joined together through reflow processes, the components are prevented from being rotated or displaced. As a result, the process yield can be increased.

Moreover, markings for detecting a mounting direction may be provided on the diaphragm-unit, or cutouts may be provided in a part of the diaphragm-unit. As a result, occurrence of mount failures can be prevented by use of image recognition, and the like.

In addition, in the present embodiment, the entirety of the diaphragm-unit 20 is arranged in the recess of the diaphragm-unit arrangement area 11. By such a configuration, a microphone unit that is resistant to physical shock from a direction parallel to the opening 12 and that is easier to handle can be implemented.

When the diaphragm-unit 20 is arranged directly on the face of the microphone substrate 10, a cover covering the microphone substrate 10 and the diaphragm-unit 20 is often used for preventing fracture of the diaphragm-unit 20 during handling. In the present embodiment, the entirety of the diaphragm-unit 20 is disposed in the recess of the diaphragm-unit arrangement area 11. Therefore, the fracture of the diaphragm-unit 20 by physical shock from the direction parallel to the opening 12 is prevented. As a result, a configuration not involving use of a cover can be feasible, and a thickness reduction can be possible. Since there is no acoustic impedance in a space made by the cover, a microphone unit can have a high-quality characteristic.

In addition, in the present embodiment, the microphone substrate 10 has, on its single face side, the opening 12 of the diaphragm-unit arrangement area 11 and an opening 32 of a recess that is to serve as the signal processor arrangement area 30. As a result, the diaphragm-unit 20 and the signal processor 40 may be disposed from a single face side of the microphone substrate 10, and hence manufacturing processes can be made simple.

Moreover, as various occasions arise, the opening 12 of the recess of the diaphragm-unit arrangement area 11 may be formed on one face of the microphone substrate 10, and the opening 32 of the recess of the signal processor arrangement area 30.

The microphone units 1 and 1' of the embodiment are arranged so that sound pressure can be input from both obverse face and reverse face sides of the microphone substrate 10 and that the microphone unit can work as a differential microphone by having one diaphragm 22.

Figure 4A:
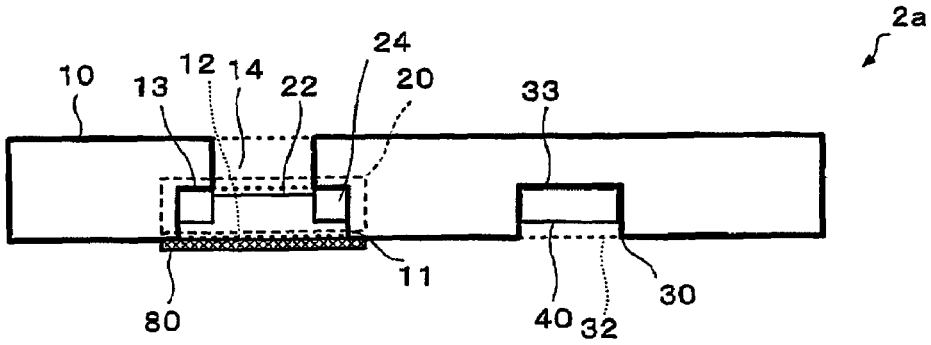
FIG. 4A is a plan view of a microphone unit according to a second embodiment of the present invention.
Figure 4B:
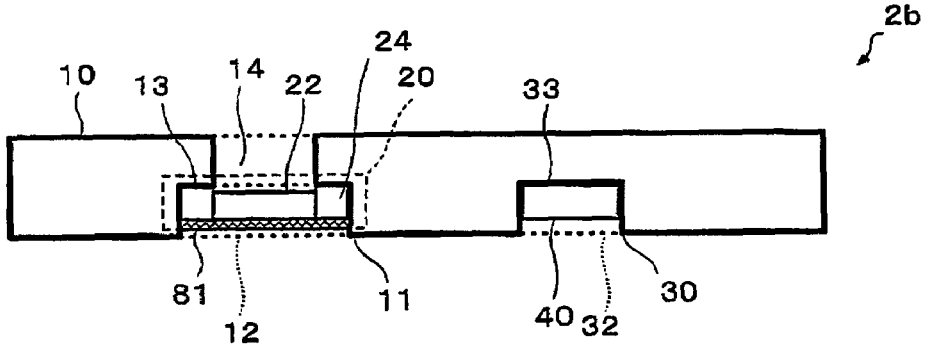
FIG. 4B is a sectional view of the microphone unit shown in FIG. 4A.

A microphone unit of a second embodiment of the present invention, which may serve as omnidirectional microphones, is described below by reference to FIGS. 4A and 4B. Components similar to those in the first embodiment and the previous embodiment will be denoted by the same reference numerals and repetitive explanations for those will be omitted. For instance, as in the case of a microphone unit 2*a* shown in FIG. 4A, the microphone unit may be configured so as to include a microphone cover 80 that closes the opening 12 of the diaphragm-unit arrangement area 11. Further, as in the case of a microphone unit 2*b* shown in FIG. 4B, the diaphragm-unit 20 may be configured so as to include a microphone cover 81 that closes a face of the diaphragm 22 opposite to the through hole 14.

According to the second embodiment, only sound pressure passed through the through hole 14 incidents the diaphragm 22. Hence, the microphone units 2*a* and 2*b* work as omnidirectional microphones.

In the second embodiment, the recess of the diaphragm-unit arrangement area 11 is configured so as to have a pillar shape that the opening 12 and the parallel face 13 have same shape. However, the recess may be configured so as to have another shape.

A third embodiment of the present invention is described by reference to FIGS. 5A and 5B. The third embodiment is a microphone unit, wherein the recessed diaphragm-unit arrangement area 11 has a shape that has an opening 11 wider than the parallel face 13 so that the entire parallel face 13 becomes in viewed from the opening 12. Therefore, the diaphragm-unit 20 can be easily inserted into the recessed diaphragm-unit arrangement area 11, and can be easily disposed at a desired position. Components similar to those in the first embodiment and previous embodiments will be denoted by the same reference numerals and repetitive explanations for those will be omitted. In the third embodiment, the recessed diaphragm-unit arrangement area 11*a* has a pyramidal shape that spreads toward an opening 12*a*; namely, the cross section thereof becomes smaller from the opening 12*a* toward the parallel face 13. As in the case of the microphone unit 1*b* shown in FIGS. 6A and 6B, a part of the opening 12*b* can be tapered.

The same applies to the shape of a recess that is to serve as the signal processor arrangement area 30. In the first and second embodiments, a shape of the recess of the signal processor arrangement area 30 is a pillar shape wherein the opening 32 and the bottom face 33 have a same shape. However, the recessed signal processor arrangement area 30 may have the opening 32 wider than the bottom face 33, so that the whole part of the bottom face 33 is visible when viewed from the opening 32. As a result, the signal processor 40 becomes to easily be inserted to the recess of the signal processor arrangement area 30.

Figures 5A, 5B:
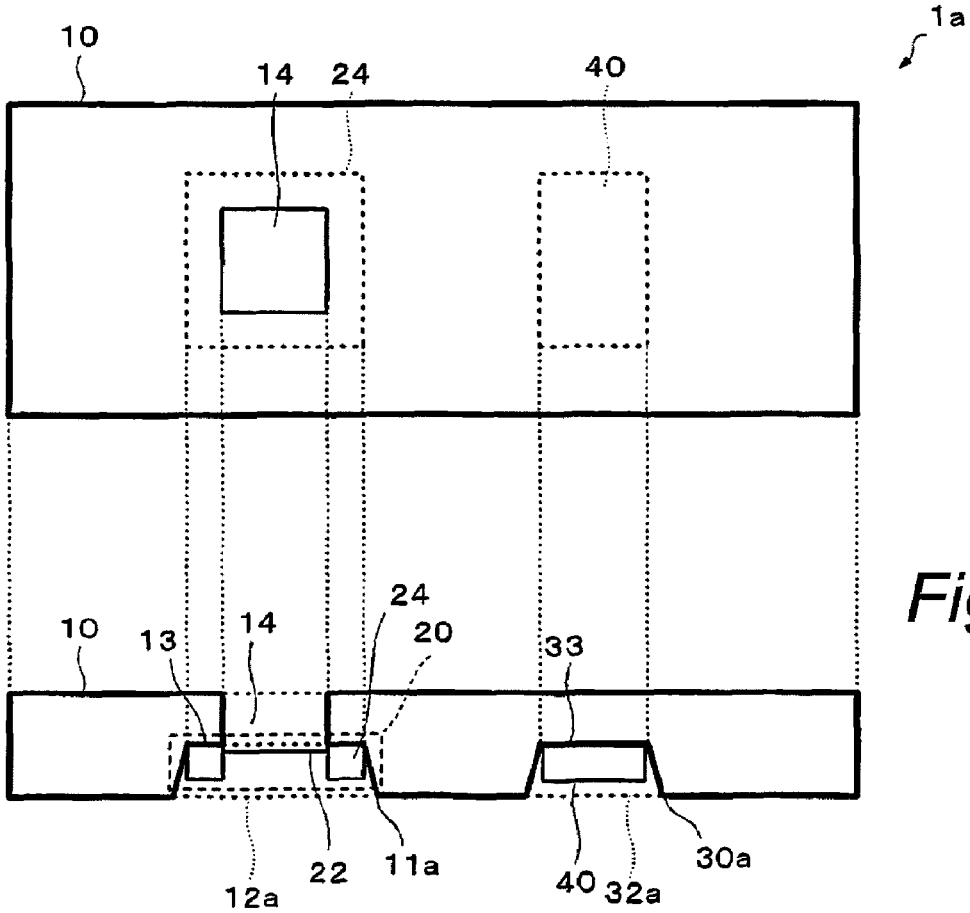
FIG. 5A is a plan view of a microphone unit according to a third embodiment of the present invention.
FIG. 5B is a sectional view of the microphone unit shown in FIG. 5A.
Figures 6A, 6B:
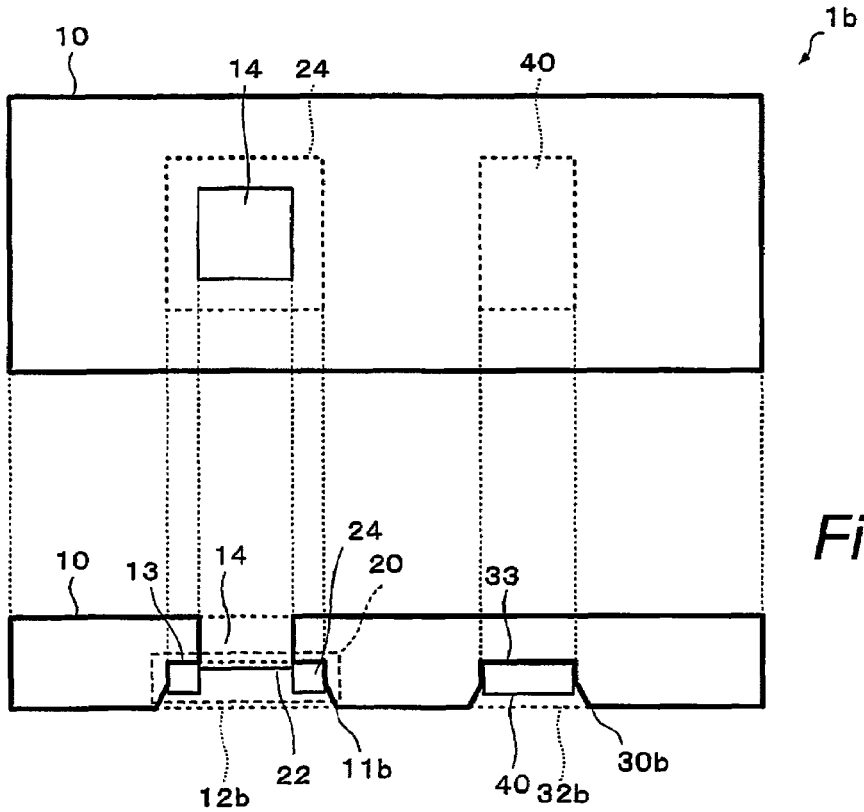
FIG. 6A is a plan view of modified example of the microphone unit shown in FIG. 5A.
FIG. 6B is a sectional view of the microphone unit shown in FIG. 6A.

For instance, as in the case of the microphone unit 1*a* shown in FIGS. 5A and 5B, a shape of the recessed signal processor arrangement area 30*a* may be a pyramidal shape that spreads toward the opening 32*a*; namely, the cross section thereof becomes smaller from the opening 32*a* toward the bottom 33. As in the case of the microphone unit 1*b* shown in FIGS. 6A and 6B, a part of the diaphragm-unit arrangement area 30*b* in the vicinity of the opening 32*b* may be tapered.

Figure 7A:
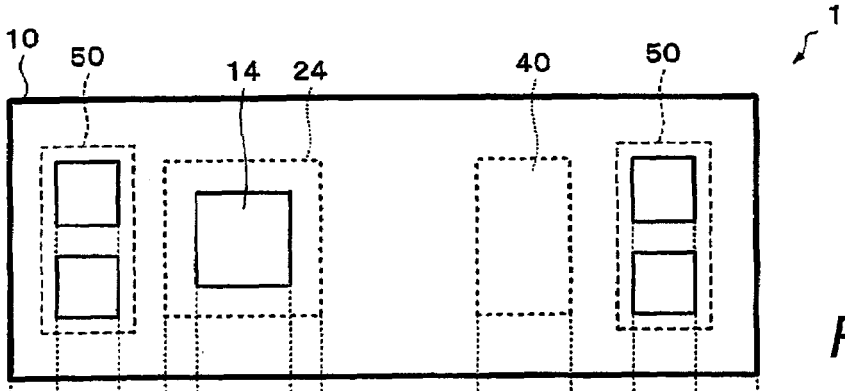
FIG. 7A is a plan view of a microphone unit according to a fourth embodiment of the present invention.
Figure 7B:
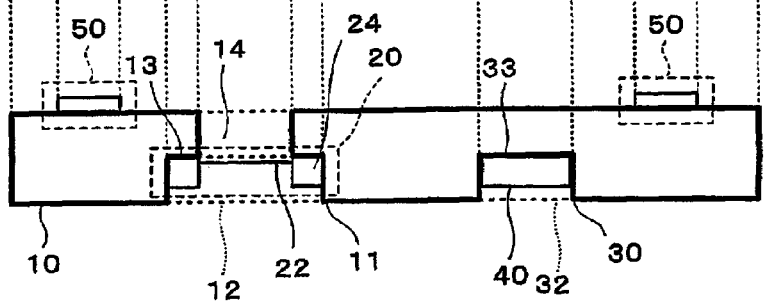
FIG. 7B is a sectional view of the microphone unit shown in FIG. 7A.
Figure 7C:
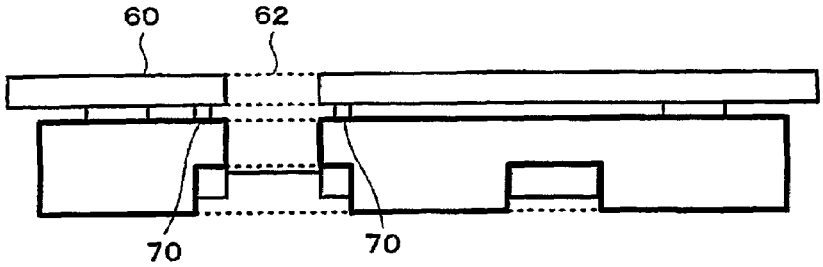
FIG. 7C is a sectional view showing the microphone unit shown in FIG. 7A connected to a substrate.

A microphone unit of a fourth embodiment of the present invention is described by referenced to FIGS. 7A to 7C. Components similar to those in the first embodiment and previous embodiments will be denoted by the same reference numerals and repetitive explanations for those will be omitted. In the fourth embodiment, in addition to the configuration described in the previous embodiments, the microphone substrate 10 includes, on a reverse face of the microphone substrate 10, an electrode part 50 electrically connected to the signal processor 40.

A wiring board 60 includes wiring to another unillustrated electric circuit and is electrically connected to the electrode part 50. The wiring board 60 may have a through hole 62 for guiding acoustic waves to the diaphragm 22 at a position overlapping the through hole 14.

An area on one face of the wiring board 60 surrounding the through hole 62 in every direction may be joined an area on the reverse face of the microphone substrate 10 surrounding the through hole 14 in every direction and opposing the area of the wiring board 60. For instance, the microphone unit 1 may comprise a sealing part 70 that continuously surrounds a circumference of the through hole 62 on the one face of the wiring board 60, and continuously surrounds a circumference of the through hole 14 on the reverse face of the microphone substrate 10 joins the wiring board 60 to the microphone substrate 10. As a result, the sealing section 70 can prevent sound from leaking into the through hole 14 through a clearance between the microphone substrate 10 and the wiring board 60.

The sealing part 70 may be made of solder. Moreover, the sealing part may be made of a conductive adhesive such as silver paste, or a nonconductive adhesive. Further, the sealing part may be made of a material capable of ensuring airtightness, such as an adhesive seal. The microphone unit 1 can be disposed on a back face of the wiring board 60 by such a configuration.

The microphone substrate 10 includes, on the obverse face, an electrode part 50*a* electrically connected to the signal processor 40.

A microphone unit of a fifth embodiment of the present invention is described by reference to FIGS. 8A to 8C. Components similar to those in the first embodiment and previous embodiments will be denoted by the same reference numerals and repetitive explanations for those will be omitted. In the fifth embodiment, the microphone substrate 10 includes, on the obverse face, an electrode part 50*a* electrically connected to the signal processor 40.

A wiring board 60*a* includes wiring to another unillustrated electric circuit and is electrically connected to the electrode part 50*a*.

The wiring board 60*a* may be joined to an area surrounding the opening 12 in every direction. For instance, the microphone unit 1 may comprise a sealing part 70*a* that continuously surrounds the circumference of the opening 12 and that joins the microphone substrate 10 to the wiring board 60*a*. As a result, the sealer 70*a* can prevent sound from leaking into the opening 12 through a clearance between the microphone substrate 10 and the wiring board 60*a*.

By adoption of such a configuration, the microphone unit 1 can be disposed on a front face of the wiring board 60*a* as is another unillustrated electric circuit.

The previous embodiments are described by reference to the embodiment including a single diaphragm-unit 20. However, the microphone unit may include a plurality of diaphragm-units, and diaphragm-unit arrangement areas and through holes respectively corresponding to the plurality of diaphragm-units.

Figures 9A, 9B:
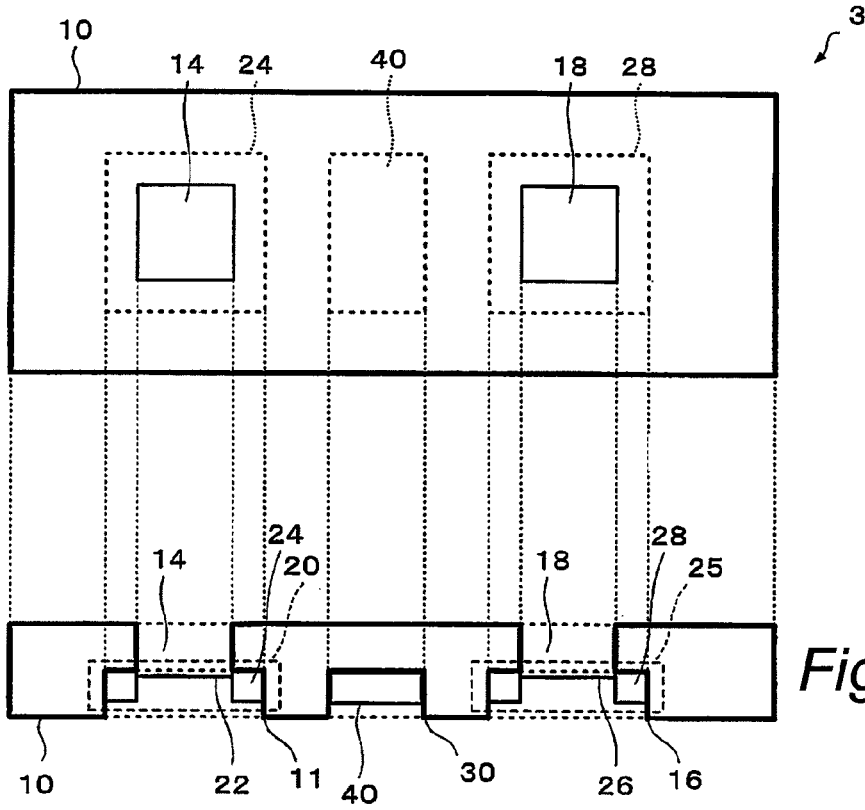
FIG. 9A is a plan view of a microphone unit according to a sixth embodiment of the present invention.
FIG. 9B is a sectional view of the microphone unit shown in FIG. 9A.

A microphone unit of a sixth embodiment of the present invention is described by reference to FIGS. 9A and 9B. Elements that are identical with those described in connection with the embodiments are assigned the same reference numerals, and their repeated explanations are omitted for brevity. In the sixth embodiment, the signal processor 40 can perform signal processing for generating a differential signal by using of signal output from any two of the plurality of diaphragm-units.

The microphone substrate 10 includes a diaphragm-unit arrangement area 16 and a through hole 18 corresponding to a diaphragm-unit 25, and a diaphragm-unit arrangement area 11 and a through hole 14 corresponding to the diaphragm-unit 20.

For instance, in a differential microphone that generates and utilizes a differential signal indicating a difference between signals output from two microphones, a positional relationship between the two microphones is an important design factor that affects a characteristic of a sound input device. According to the sixth embodiment, the diaphragm-units 20 and 25 serving as microphones can be disposed at desired locations.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The present invention encompasses a configuration which is substantially the same as the configurations described with the embodiments (for example, a configuration from which the same function, method or result is obtained, or object or effect of which is the same). The present invention also encompasses a configuration in which a non-essential part in the configurations described with the embodiments is replaced. The present invention also encompasses a configuration from which the same advantageous effect can be obtained or by which the same object can be attained as in the configurations described with the embodiments. The present invention also encompasses a configuration wherein a well-know art is added to the configurations described with the embodiments.

What is claimed is:

1. A microphone unit, comprising:

a substrate including:

a first face formed with a first recess and an opening;

a second face opposite to the first face; and a through hole communicating the second face to a bottom part of the first recess; and a diaphragm unit including:

a diaphragm; and a holding part configured to support the diaphragm, wherein at least part of the holding part is set from the opening and is fit into the first recess so that the diaphragm opposes the through hole, and wherein the holding part is in direct contact with a side wall of the recess.

2. The microphone unit set forth in claim 1, wherein the first recess is opened while being enlarged from the bottom part.

3. The microphone unit set forth in claim 1, further comprising a cover covering the first recess.

4. The microphone unit set forth in claim 1, further comprising a cover covering the diaphragm in the first recess.

5. The microphone unit set forth in claim 1, wherein the opening of the first recess has a polygonal shape.

6. The microphone unit set forth in claim 1, wherein the opening of the first recess has a circular shape.

7. The microphone unit set forth in claim 1, wherein a whole part of the diaphragm unit is disposed in the first recess.

8. The microphone unit set forth in claim 1, further comprising a signal processor configured to process a signal output from the diaphragm unit, wherein the substrate is formed with a second recess accommodating at least a part of the signal processor.

9. The microphone unit set forth in claim 8, wherein the second recess is formed in the first face of the substrate.

10. The microphone unit set forth in claim 8, further comprising an electrode disposed on the first face of the substrate and electrically connected to the signal processor.

11. The microphone unit set forth in claim 8, further comprising an electrode disposed on the second face of the substrate and electrically connected to the signal processor.

12. A method for manufacturing a microphone unit, comprising:

preparing a substrate comprising a first face formed with a first recess and an opening at the first face, a second face opposite to the first face, and through hole communicating the second face to a bottom part of the first recess;

preparing a diaphragm unit including a diaphragm; and disposing at least part of the diaphragm unit in the first recess so the diaphragm opposes the hole, wherein a holding part configured to support the diaphragm is in direct contact with a side wall of the recess.

13. A microphone unit, comprising:

a substrate including:

a first face formed with a first recess and a second recess and an opening;

a second face opposite to the first face;

a first through hole communicating the second face to a bottom part of the first recess; and a second through hole communicating the second face to a bottom part of the second recess;

a first diaphragm unit comprising a diaphragm disposed in the first recess;

a second diaphragm unit comprising a diaphragm disposed in the second recess; and a signal processor configured to process signals from the first diaphragm unit and the second diaphragm unit, wherein a holding part configured to support at least one of the first diaphragm and the second diaphragm is in direct contact with a side wall of the at least one of the first recess and the second recess.

14. The microphone unit set forth in claim 13, wherein the first recess is opened while being enlarged from the bottom part of the first recess, and the second recess is opened while being enlarged from the bottom part of the second recess.

15. The microphone unit set forth in claim 13, further comprising a first cover covering the first recess; and a second cover covering the second recess.

16. The microphone unit set forth in claim 13, further comprising a first cover covering the diaphragm in the first recess; and a second cover covering the diaphragm in the second recess.

17. The microphone unit set forth in claim 13, wherein the opening of at least one of the first recess and the second recess has a polygonal shape.

18. The microphone unit set forth in claim 13, wherein the opening of at least one of the first recess and the second recess has a circular shape.

19. The microphone unit set forth in claim 13, wherein a whole part of the first diaphragm unit is disposed in the first recess; and a whole part of the second diaphragm unit is disposed in the second recess.

* * * * *